US006689979B1

(12) United States Patent
Bach et al.

(10) Patent No.: US 6,689,979 B1
(45) **Date of Patent: *Feb. 10, 2004**

(54) SWITCHING CONTACT ARRANGEMENT OF A LOW VOLTAGE CIRCUIT BREAKER WITH MAIN CONTACTS, INTERMEDIATE CONTACT AND ARCING CONTACTS

(75) Inventors: Michael Bach, Berlin (DE); Detlev Schmidt, Berlin (DE); Michael Sebekow, Berlin (DE); Guenter Seidler-Stahl, Berlin (DE); Ingo Thiede, Berlin (DE); Sezai Tuerkmen, Berlin (DE)

(73) Assignee: Siemens Aktiengesellschaft, Munich (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 35 days.

(21) Appl. No.: 10/030,641

(22) PCT Filed: Jul. 3, 2000

(86) PCT No.: PCT/DE00/02185

§ 371 (c)(1),
(2), (4) Date: Apr. 17, 2002

(87) PCT Pub. No.: WO01/03153

PCT Pub. Date: Jan. 11, 2001

(30) Foreign Application Priority Data

Jul. 2, 1999 (DE) ..... 199 32 010

(51) Int. Cl.[7] ..... H01H 33/18

(52) U.S. Cl. ..... 218/40; 335/16; 335/201; 218/22

(58) Field of Search ..... 218/22, 27, 30, 218/31, 32, 36, 40, 146; 335/201, 202, 167–176, 147, 195, 16

(56) References Cited

U.S. PATENT DOCUMENTS

| | | | | |
|---|---|---|---|---|
| 6,100,490 A | * | 8/2000 | Turkmen | 218/22 |
| 6,188,031 B1 | * | 2/2001 | Turkmen | 218/154 |
| 6,417,474 B1 | * | 7/2002 | Rakus et al. | 218/148 |
| 6,507,256 B1 | * | 1/2003 | Castonguay et al. | 335/172 |

FOREIGN PATENT DOCUMENTS

| | | |
|---|---|---|
| DE | 1118317 | 1/1960 |
| DE | 296 15 566 U1 | 2/1998 |
| DE | 197 27 696 A1 | 12/1998 |
| EP | 930101 | 7/1963 |
| EP | 0 325 767 B1 | 8/1989 |
| EP | 0 410 902 A1 | 1/1991 |
| EP | 0 410 902 B1 | 1/1991 |
| EP | 0 859 387 A2 | 8/1998 |
| FR | 1.019.187 | 1/1953 |

OTHER PUBLICATIONS

"Grundlagen der Schaltgeratetechnik", A. Erk et al., pp. 272–292.

* cited by examiner

*Primary Examiner*—Lincoln Donovan
(74) *Attorney, Agent, or Firm*—Harness, Dickey & Pierce, P.L.C.

(57) ABSTRACT

A switching contact arrangement for a low-voltage power circuit breaker includes a switching contact arrangement with a stationary contact group and a movable contact group which interacts with it. The contact groups include interacting main contacts, as well as interacting intermediate contacts and consumable contacts. Furthermore, both contact groups are equipped with an arcing horn for passing a switching arc to an arc quenching chamber. The consumable contacts are integrated in the arcing horns. Only the main contacts are in the form of contact facings, while the other contact points are formed by the busbars or arcing horns. The switching contact arrangement is of a single design and achieves a longer mechanical and electrical life. Furthermore, particularly short switching times are achieved.

1 Claim, 2 Drawing Sheets

SWITCHING CONTACT ARRANGEMENT OF A LOW VOLTAGE CIRCUIT BREAKER WITH MAIN CONTACTS, INTERMEDIATE CONTACT AND ARCING CONTACTS

This application is the national phase under 35 U.S.C. § 371 of PCT International Application No. PCT/DE00/02185 which has an International filing date of Jul. 3, 2000, which designated the United States of America, the entire contents of which are hereby incorporated by reference.

FIELD OF THE INVENTION

The invention generally relates to a switching contact arrangement for a low-voltage power circuit breaker. More preferably, the switching arrangement includes the following features:

- a stationary contact group including
  - a stationary main contact,
  - a stationary intermediate contact,
  - a stationary consumable contact, and
  - a stationary arcing horn,
- a moving contact group, which is arranged such that it can move relative to the stationary contact group for connection and disconnection,
  - a contact lever, which is associated with the moving contact group and is mounted such that it can pivot against the force of a contact force spring, and having
    - a movable main contact,
    - a movable intermediate contact,
    - a movable consumable contact, and
    - a movable arcing horn,
- with the capability of the contact lever to pivot during disconnection allowing the consumable contacts to open after the opening of the main contacts formed by contact facings.

BACKGROUND OF THE INVENTION

Switching contact arrangements have been disclosed in DE-B 1 118 317. They are distinguished in comparison to arrangements including only one or two contact points by having a higher switching capacity, a longer life and less heating during long-term connection. They are thus used in low-voltage power circuit breakers for particularly demanding loads, and can be designed for a rated current of several thousand amperes and a switching capacity of up to 100 000 A. The disconnection process takes place in such a way that the final disconnection of the movable contact group from the stationary contact group takes place only on the consumable contacts which, in accordance with their function, are also referred to as arcing contacts or else initial contacts. The main contacts are opened first of all, so that they are not loaded, or are loaded only slightly, by switching arcs. The main contacts thus remain in a good condition over a large number of switching operations, and the current carrying capacity is maintained over a long time period, with little heating during continuous operation.

It has already been mentioned that it is desirable for the switching contact arrangement to be heated as little as possible during long-term connection and when loaded with a high continuous current. Apart from reducing the load from switching arcs on the main contacts by way of the consumable contacts, it is also known for a small amount of heating to be achieved by way of special contact facings which contain a noble metal, particularly silver, and further additives which ensure the desired mechanical hardness, as little tendency as possible to welding with an interacting contact, and resistance to corrosion. Contact facings of this type require complex production processes, and must be connected permanently, and over a large area, to their support by soldering or welding. Equipping switching contacts with contact facings of this type thus represents a considerable proportion of the costs of the switching contact arrangement for a power circuit breaker. The switching contact arrangement according to the cited DE-B 1 118 317 adopted the approach of designing all three contact points, that is to say the main contacts, intermediate contacts and consumable contacts, as suitably shaped contact facings, with the three contacts being combined in a single length, corresponding to a flat bearing plate, only on the side of the movable contact group. Thus, when connected, both the main contacts and the intermediate contacts are touching. During disconnection, the movable contact lever pivots about the intermediate contact, with the main contacts being disconnected and the consumable contacts meeting one another. As the disconnection process continues, only the consumable contacts still touch, before they are also disconnected, with a switching arc being formed.

With regard to the considerable cost contribution from contact facings in switching contact arrangements, there is a desire to restrict the number of contact points and their equipment with contact facings composed of special contact materials. Thus, for example, it is already known for only two contact points to be provided per switching contact arrangement, namely main contacts and consumable contacts, and for only the two main contacts to be designed as contact facings composed of special contact material (DE 197 27 696 A1). Combinations are also known, in such a manner that, in addition to the two main contacts, only one of the consumable contacts has a contact facing (EP 0 325 767 B1). Those contact points which have no contact facings are in this case located directly on the main bodies (which are generally composed of copper or steel) of the current path through the power circuit breaker, such as busbars, contact levers and arcing horns. The particular performance that is intrinsic with the contact arrangement according to DE-1 118 317 B described initially can thus, however, not be achieved without further effort.

Furthermore, a contact arrangement having three contact points is known (FR 1 019 187 A), during whose opening the two main contacts, which are arranged like a bridge, the intermediate contacts and the consumable contacts are disconnected successively. Only the main contacts have contact facings. In this contact arrangement, an arcing horn which forms the movable intermediate contact and the movable consumable contact is arranged such that it can pivot on the contact lever, and has the force of its own contact force spring applied to it. The contact lever is itself subject to the influence of a contact force spring, which is a component of a coupling element that connects the contact lever to an operating shaft. This contact system simplifies the pivoting arrangement of the movable arcing horn on the contact lever, ensuring the desired movement sequence with sequential disconnection of the contact points. On the other hand, the accommodation of the two contact force springs is physically more difficult, the two springs are different and, since the two springs are mechanically connected in series, problems can arise in maintaining the desired contact forces.

SUMMARY OF THE INVENTION

In this context, the invention is based on an object of providing a switching contact arrangement having triple contacts of the type mentioned initially. Preferably, the production involves considerably less effort, and the switching contact arrangement is distinguished by a longer life.

According to the invention, an object is achieved by at least one of the following further features:

- the pivoting contact lever is integral and has the movable main contact, the movable intermediate contact, the movable consumable contact and the movable arcing horn,
- the contact lever is itself arranged such that it can pivot on a contact support which can move about a pivoting bearing in the power circuit breaker, and the pivoting of the contact lever relative to the contact support about an associated pivoting bearing is limited by a stop,
- the contact force spring is arranged between the contact support and the contact lever,
- the stationary intermediate contact is formed by an end surface of a busbar to which the stationary main contact is fitted,
- the stationary consumable contact is formed by an outward bulge on the stationary arcing horn which projects beyond the end surface of the busbar, on the movable arcing horn, and
- the movable intermediate contact is formed by an outward bulge
- the movable consumable contact is formed by a subsection of that flank of the movable arcing horn which faces the stationary arcing horn.

The advantages of a switching contact arrangement with triple contacts are in this way achieved using only one pair of contact facings, by a specific arrangement and configuration or modification of components of a switching contact arrangement in the way that they have already been used in the past. There is thus no need for any additional parts, or parts which are complex to manufacture. Nevertheless, a longer life is achieved, since the contact lever is caught during connection with its arcing horn on the stationary contact group and is largely relieved of a bending load which would otherwise occur. This allows contact levers with a relatively small cross section to be chosen, which is advantageous for the achievable switching speeds. The stop makes a contribution to achieving high switching speeds since, during connection, the pivoting angle of the contact lever after the consumable contacts touch and until the intermediate contacts touch is restricted, and the mechanical load is accordingly reduced.

BRIEF DESCRIPTION OF THE DRAWINGS

The invention will be explained in more detail in the following text with reference to an exemplary embodiment, which is illustrated in the figures.

Figure 2:
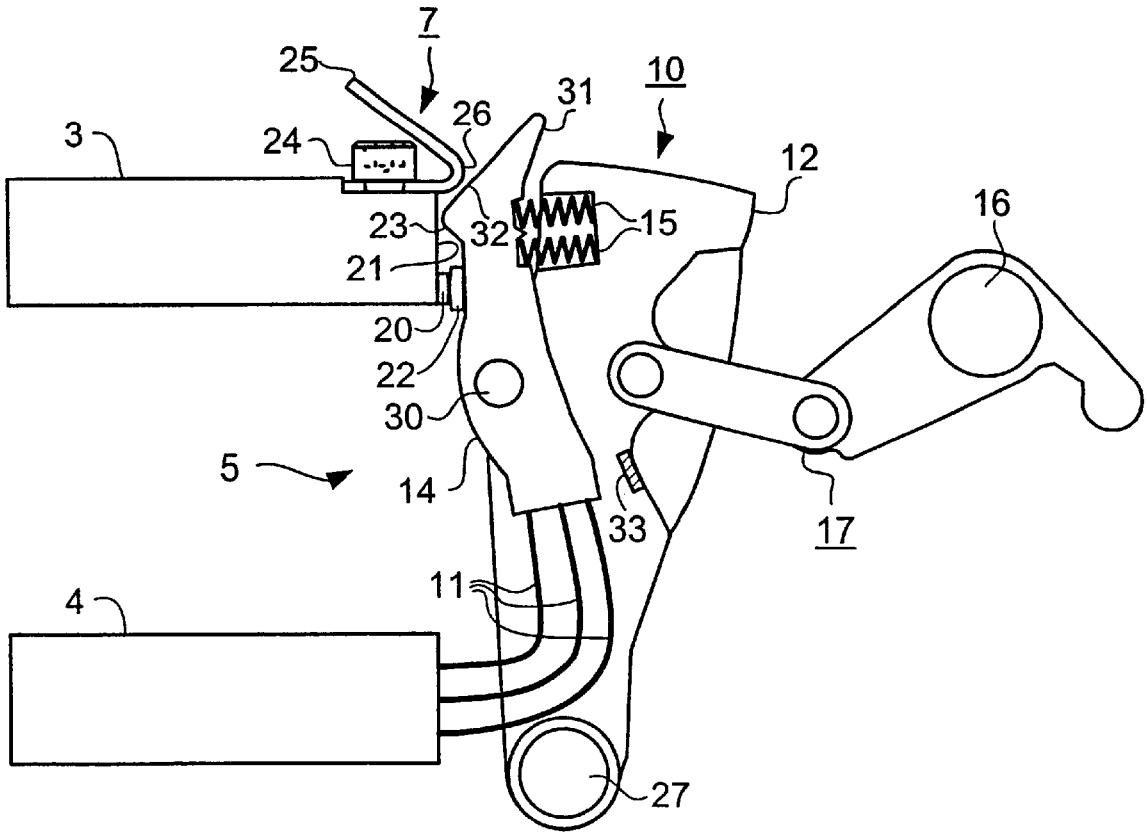
FIG. 2 shows a switching contact arrangement according to the invention, in the connected state.
Figure 3:
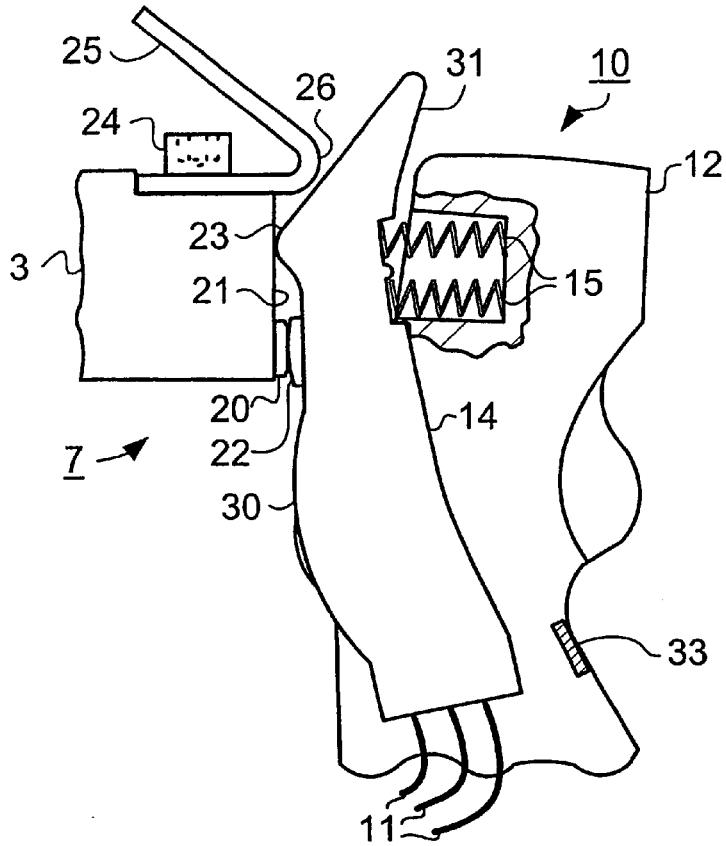
Figure 4:
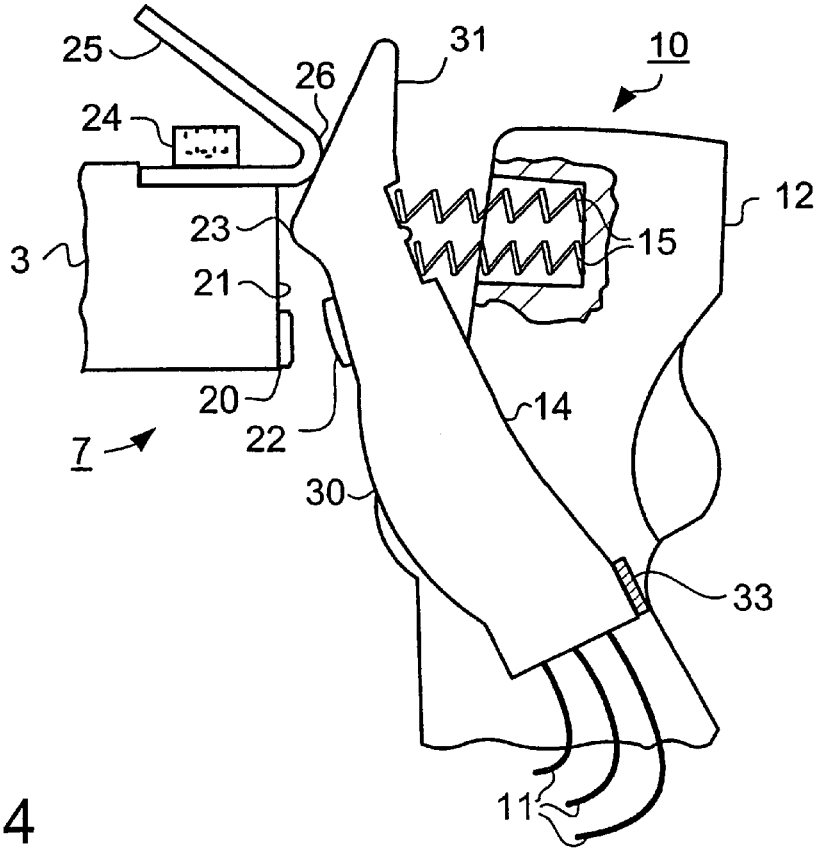

Parts of the switching contact arrangement that are significant to the invention as shown in FIG. 2 are illustrated in successive phases of a disconnection process in FIGS. 3 and 4.

DETAILED DESCRIPTION OF THE PREFERRED EMBODIMENTS

Figure 1:
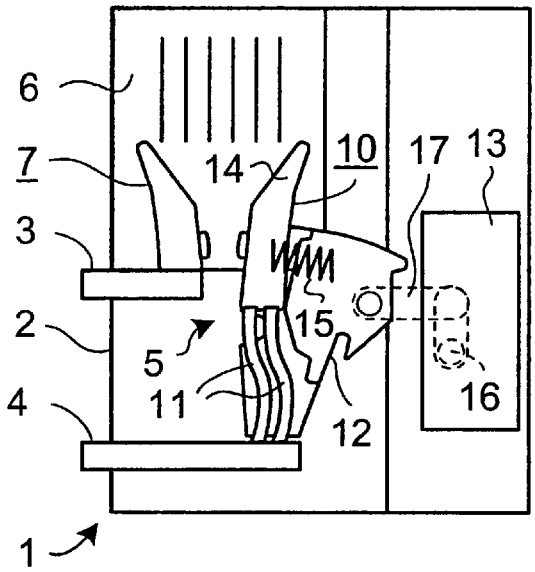
FIG. 1 shows a schematic illustration of a low-voltage power circuit breaker with a switching contact arrangement.

The multipole low-voltage power circuit breaker 1 shown, schematically in the form of a section, in FIG. 1 includes an enclosure 2 and busbars 3 and 4 which project from it at the rear. A switching contact arrangement, which is annotated 5 overall, is electrically connected to the busbars 3 and 4 and allows a circuit for loads (not illustrated) to be made and broken. Located above the switching contact arrangement 5 in the enclosure 2 there is an arc quenching chamber 6 which contains arcing plates arranged transversely with respect to a switching arc, in a known manner. The switching contact arrangement 5 includes a stationary contact group 7, which is connected to the upper busbar 3, and a movable contact group 10, which is connected by flexible conductors 11 to the lower busbar. The movable contact group 10 includes a contact support 12, which is mounted in the enclosure 2 of the power circuit breaker 1 such that it can pivot, and can be operated by a drive apparatus 13 for connection and disconnection. A contact lever 14, which is mounted on the contact support 12 such that it can pivot, is prestressed by a contact force spring 15 in the direction of the stationary contact group 7. A switching shaft 16 is used to distribute the drive force produced by the drive apparatus 13 between a number of switching contact arrangements 5, which are arranged parallel to one another in the enclosure 2, and each of which is connected by a lever drive 17 to the switching shaft 16.

The same reference symbols are used for those parts which match those in FIG. 1 in the following FIGS. 2, 3 and 4.

It can be seen from the enlarged illustration in FIG. 2 that the stationary contact group 7 is provided on the end surface of its busbar 3 with a contact facing which forms a stationary main contact 20. That part of the end surface of the busbar 3 which is located above the main contact 20 forms a stationary intermediate contact 21. A movable main contact 22 interacts with the stationary main contact 20, and is formed by a contact facing applied to the contact lever 14. An outward bulge on the contact lever 14 is used as a movable intermediate contact 23.

A stationary arcing horn 25 is mounted on the busbar 3 by a screw connection 24, has an outward bulge which projects beyond the busbar 3, and in consequence forms a stationary consumable contact 26.

As already mentioned, the movable contact group 10 includes a contact support 12 and a contact lever 14. The contact support 12 can move about a fixed-position pivoting bearing 27, while the contact lever 14 can move about a pivoting bearing 30 arranged on the contact support 12. Two parallel contact force springs 15 are supported on the contact support 12, and prestress the contact lever 14 against the stationary contact group 7. Above the intermediate contact 23, the contact lever 14 is in the form of an arcing horn 31, with a subsection of the arcing horn 31 being used as a movable consumable contact 32, as will be explained.

When the switching contact arrangement 5 is in the connected position as shown in FIG. 2, only the main contacts 20 and 22 make contact with one another, as a result of which the main current path of the power circuit breaker 1 is made from the upper busbar 3 via the contact lever 14, the flexible conductor 11 and the lower busbar 4.

The process of changing the switching contact arrangement 5 to the OFF position is initiated in a known manner by appropriate rotation of the switching shaft 16. The contact support 12 now pivots clockwise, while the contact lever 14 initially still remains engaged with the stationary contact group 7 under the influence of the contact force springs 15 and, in the process, pivots counterclockwise about its pivoting bearing 30, which is located on the contact support 12. The position shown in FIG. 3 occurs in this case as a first characteristic intermediate position. This position is distinguished in that both the main contacts 20 and 22 and the intermediate contacts 21 and 23 are touching. In consequence, the current flowing via the switching contact arrangement 5 starts to commutate onto the intermediate contacts.

As the disconnection process continues, a further contact point becomes effective, and this is formed by the stationary consumable contact 26 on the arcing horn 25 and the movable consumable contact 32 on the arcing horn 31 of the contact lever 14. FIG. 4 shows, as a further characteristic intermediate position, the state in which both the main contacts 20 and 22 and the intermediate contacts 21 and 23 have been disconnected from one another, and the current to be interrupted now flows only via the consumable contacts 26 and 32. When the subsequent disconnection of the contact lever 14 from the stationary contact group 7 takes place, a switching arc is struck between the consumable contacts 26 and 32. Since, as explained above, the consumable contacts are components of the stationary arcing horn 25 and of the movable arcing horn 31, this therefore results in particularly advantageous conditions for continued operation of the switching arc and for it to be moved onward into the arc quenching chamber 6 (FIG. 1). This characteristic allows surprisingly short switching times.

During the connection process, the characteristic intermediate positions which have been explained are assumed in the opposite sequence. Thus, as shown in FIG. 4, the consumable contacts 26 and 32 touch first, before the positions shown in FIGS. 3 and 2 are assumed. Since the movable consumable contact 32 is arranged in that flank of the arcing horn 31 of the contact lever 14 which faces the stationary arcing horn 25, the contact lever 14 is mechanically caught close to its end. In contrast, in the previously normal contact arrangements, the position at which the contacts first touch during the connection process is located closer to the center of the contact lever, which can lead to a considerable bending load on the contact lever 14. In this context, it is important that the pivoting of the contact lever about its pivoting bearing 30 on the contact support 12 is limited by a stop 33. If the stop 33 is positioned in a suitable manner, this means that the contact lever pivots only to a minor desired extent after the consumable contacts 26 and 32 have touched, or that virtually no pivoting takes place by virtue of the mutual matching between the consumable contacts and the intermediate contacts. This means that the intermediate contacts are closed shortly after the consumable contacts, or virtually at the same time as them. This results in a considerable increase in both the electrical and mechanical life of the switching contact arrangement.

Although one contact lever has in each case been mentioned during the course of the above description, this should be understood as meaning that the invention can also be used in conjunction with the known multiple contact systems (see, for example, DE 296 15 566 U1, EP 0 410 902 B1). The described configuration of the arcing horns should also be regarded only as being an example. The stationary arcing horn 25 can thus also be formed integrally with the stationary intermediate contact 21 (EP 0 325 767 B1) or, additionally, can be formed integrally with the busbar (EP 0 859 387 A2). On the other hand, the moving arcing horn may be designed, in a known manner, as a separate part and may be mounted on the contact lever (EP 0 325 767 B1). Other embodiments of stops for limiting the pivoting angle of the contact lever 14 are equally regarded as being suitable for the purposes of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A switching contact arrangement for a low-voltage power circuit breaker, comprising:

a stationary contact group including,
- a stationary main contact,
- a stationary intermediate contact,
- a stationary consumable contact, and
- a stationary arcing horn;

a moving contact group, arranged to be movable relative to the stationary contact group for connection and disconnection, and a contact lever, associated with the moving contact group and mounted to be pivotable against the force of a contact force spring, and including,
- a movable main contact,
- a movable intermediate contact,
- a movable consumable contact, and
- a movable arcing horn; wherein the capability of the contact lever to pivot during disconnection permits the consumable contacts to open after the opening of the main contacts formed by contact facings, and wherein the pivoting contact lever is integral to and includes the movable main contact, the movable intermediate contact, the movable consumable contact and the movable arcing horn, the contact lever is itself arranged to be pivotable on a contact support which can move about a pivoting bearing in the power circuit breaker, and the pivoting of the contact lever relative to the contact support about an associated pivoting bearing is limited by a stop, the contact force spring is arranged between the contact support and the contact lever, the stationary intermediate contact is formed by an end surface of a busbar to which the stationary main contact is fitted, the stationary consumable contact is formed by an outward bulge on the stationary arcing horn which projects beyond the end surface of the busbar, on the movable arcing horn, the movable intermediate contact is formed by an outward bulge, and the movable consumable contact is formed by a subsection of that flank of the movable arcing horn which faces the stationary arcing horn.

* * * * *